US006712680B2

(12) United States Patent
Pellegrin

(10) Patent No.: US 6,712,680 B2
(45) Date of Patent: Mar. 30, 2004

(54) VACUUM SANDING POLE WITH ACTUATED HOSE JUNCTION

(75) Inventor: Roy J. Pellegrin, Wailuku, HI (US)

(73) Assignee: Peletex, Inc., Kahului, HI (US)

( * ) Notice: Subject to any disclaimer, the term of this patent is extended or adjusted under 35 U.S.C. 154(b) by 0 days.

(21) Appl. No.: 10/317,247

(22) Filed: Dec. 11, 2002

(65) Prior Publication Data

US 2003/0087596 A1 May 8, 2003

Related U.S. Application Data

(63) Continuation of application No. 09/906,971, filed on Jul. 16, 2001, now abandoned.
(60) Provisional application No. 60/153,759, filed on Sep. 13, 1999.

(51) Int. Cl.[7] ..... B24B 23/00
(52) U.S. Cl. ..... 451/354; 451/456
(58) Field of Search ..... 451/354, 351, 451/456, 356

(56) References Cited

U.S. PATENT DOCUMENTS 4,759,155 A * 7/1988 Shaw ..... 451/456
4,964,243 A * 10/1990 Reiter ..... 451/456
5,527,212 A * 6/1996 Bowen et al. ..... 451/456
5,540,616 A * 7/1996 Thayer ..... 451/456
5,624,305 A * 4/1997 Brown ..... 451/354
5,993,124 A * 11/1999 Cooper et al. ..... 451/456

* cited by examiner

*Primary Examiner*—Eileen P. Morgan
(74) *Attorney, Agent, or Firm*—Bruce H. Johnsonbaugh

(57) ABSTRACT

A bifurcated hose junction is provided for a pole mounted abrading device with vacuum assisted particulate removal. The junction is actuated by the movement of the sanding pad assembly. When a. short side of the rectangular sanding pad assembly is moved toward the tubular handle, the bifurcated hose junction is displaced laterally in relation to the linear axis of the handle. When a long side of the sanding pad assembly is moved toward the tubular handle, the bifurcated hose junction rotates in place, thereby allowing the sanding pad a comprehensive range of motion, in relation to the handle. The range of motion enables the operator to close the angle between sanding pad and the handle, and maintain planar contact between the sanding screen and the work surface, when working in constricted areas.

The sanding pole of the application also provides an unobstructed passageway to maintain the laminar flow of the air stream, thereby reducing turbulence and conserving the energy available to transport the particulate to the vacuum source. Conserving energy maintains the efficiency of the system, allowing the operator to maintain a high sanding pace without reducing the effective removal of abraded particulate.

4 Claims, 7 Drawing Sheets

VACUUM SANDING POLE WITH ACTUATED HOSE JUNCTION

CROSS REFERENCE TO RELATED APPLICATIONS

This application claims the benefit of U.S. provisional application Ser. No. 60/153,759 filed Sep. 13, 1999 and is a Continuation of U.S. patent application Ser. No. 09/906,971 filed Jul. 16, 2001 abandoned.

BACKGROUND AND BRIEF SUMMARY OF INVENTION

The invention relates generally to abrading tools, specifically, tools wherein a sanding pad is mounted on an extension handle and incorporating a means for vacuum assisted removal of abraded particulate. In particular, the present invention includes a sanding pad which provides laminar flow by supporting a sanding screen with a plurality of pegs, and thereby avoids the use of a plenum chamber supporting the sanding screen with flow restrictive members. The present invention provides an actuated or floating hose junction which allows the sanding pad greater freedom to rotate while keeping the sanding screen fully in contact with the surface being sanded.

The design of an efficient, effective vacuum pole sander requires consideration of several factors. The angle, between the sanding surface and the extension handle, is continuously adjustable through a sufficient range to enable the operator to sand a wide area of the work surface without changing locations. A symmetrical continuous air flow over the surface of the sanding pad is required to comprehensively draw the abraded particulate into the air stream. Additionally, an unobstructed, unconstricted passageway is required to transport the particulate toward the vacuum source.

The methods and means the prior art has used to address these factors are varied. Previous designs of vacuum pole sanders have engineered structure in attempts to solve flow dynamic inefficiencies. In many instances, the additional structure has restricted the range of motion of the sanding pad assembly, increased the air flow inefficiencies and reduced the durability of the design. Vacuum pole sanders, such as Reiter U.S. Pat. Nos. 4,964,243 and 4,779,385, which have incorporated plenum chambers, obstructions, or constrictions, that increased turbulence and reduced the efficiency of the air stream, are typical of the prior art.

Examples of vacuum pole sanders with a single vacuum hose attached between the sanding pad assembly and the tubular handle are of two basic types.

The first type is exemplified by Walters U.S. Pat. No. 5,036,627, Mehrer U.S. Pat. No. 4,062,152, and Brown U.S. Pat. No. 5,624,305; each of which encloses the universal swivel in an elastomeric boot and draws the particulate-laden air stream around the swivel. The abrasive nature of the particulate causes premature wear of the universal swivel. The unnecessary obstruction contributes to turbulence, reducing the efficiency of the air stream.

The second type, exemplified by Sanchez et al U.S. Pat. No. 5,193,313, disposes the vacuum hose along the linear axis of the base plate, a predetermined distance from the universal swivel. The vacuum hose enters the tubular handle laterally, bypassing the universal swivel. This type inherently has an asymmetrical air flow pattern across the planar surface of the sanding pad, and an asymmetrical range of motion of the sanding screen in relation to the tubular handle.

Some previous examples of vacuum pole sanders have dual vacuum hoses to improve the symmetry of the air flow across the sanding pad (see Paterson U.S. Pat. No. 5,007,206 and Thayer U.S. Pat. No. 5,540,616). The vacuum hoses are attached a predetermined distance from the end of the tubular handle, and disposed diametrically. When a short side of the rectangular sanding pad assembly is moved toward the tubular handle, the vacuum hose is compressed between the tubular handle and the sanding pad assembly. This restricts the range of motion of the sanding pad assembly.

Prior examples have not achieved laminar flow of the air stream through the tool. All have incorporated plenum chambers, with a plurality of apertures in fluid communication with the planar surface of the sanding pad, in an effort to improve the flow pattern. For example, the Reiter U.S. Pat. No. 4,964,243 requires the use of peripheral supports 24, which restrict incoming air flow and cause turbulence. According to fundamental fluid dynamic principals involving fluid moving through a pipe; as velocity increases, turbulence increases. A fluid in motion loses more energy to the effects of friction in turbulent flow than in laminar flow. The present invention achieves laminar flow through the sanding head by supporting the sanding screen without the use of flow restricting supports.

Chambers, obstructions, and constrictions disrupt the parallel streamlines of laminar flow and generate turbulence in the air stream. The path of each particle becomes unpredictable, energy is lost to heat as the particles increasingly collide with each other, the walls of the passageway, and any obstructions in the air stream.

When an air stream is moving through a pipe, a localized area of reduced vacuum is created in a chamber, in relation to the air stream, by limiting the area of the inlet apertures to less than that of the area of the outlet portal(s). The effect of the air stream moving through constricting apertures is to locally accelerate the air stream (velocity is inversely proportional to cross-sectional area), creating localized turbulence. Plenum chambers, obstructions, and constrictions reduce the efficiency of the air stream by disrupting the streamlines of laminar flow and generating turbulence. As the velocity increases, turbulence increases, reducing the efficiency of the system. Obstructions reduce efficiency by physically disrupting the streamlines and creating turbulence as the air stream is forced around the obstructions.

Various methods and means used in the prior art to improve the flow dynamics have restricted the articulation of the sanding pad assembly, reduced the efficiency of the air stream, added manufacturing costs, and reduced the structural integrity and durability of the devices. The applicant believes that inefficiencies in design of the prior art have undermined the confidence of manufacturers and consumers, and is a factor why a tool with such significant benefits is not in common use by professional tradespeople.

During the sanding process of finishing drywall, the operator is often required to sand in hallways, closets, and under stairways. The range of motion between the sanding pad and the handle of the sanding pole must be comprehensive enough to allow the operator to maintain planar contact between the sanding screen and the work surface while working in confined areas.

The present invention provides an actuated, bifurcated vacuum hose junction for a vacuum pole sander. The pole sander includes a sanding pad assembly, a bifurcated hose junction assembly, and a tubular handle assembly. The hose junction is actuated by the movement of the sanding pad in relation to the tubular handle. The hose junction is designed to "float" and is displaced when the sanding pad is moved toward the handle, allowing the operator to close the angle between the pad and the handle, and maintain contact between the sanding screen and the work surface when working in confined areas.

The sanding pole of the application achieves laminar flow through the sanding head by providing an unobstructed passageway for the air stream. The passageways extend between upstanding support pegs that carry the sanding screen. This design reduces turbulence, conserving the energy available to the system, and maintaining the efficiency of the air stream to transport the abraded particulate to the vacuum source. The operator is free to urge the sanding screen along the work surface, at pace appropriate to the time constraints of the job, without loss of effective particulate removal.

Generally, it is applicant's objective to provide drywall professionals a vacuum pole sander designed well enough to come into common use, by intuitively instilling confidence in the tool's functionality and durability. The sander of the present invention is physically robust enough to provide years of regular professional service. It collects more dust, providing a healthier environment and an advantage over competitors' sanding equipment.

Specifically, it is applicant's objective to provide a pole-mounted vacuum sanding device that maintains an air stream in laminar flow and to transport abraded particulate to a waste receptacle. Additionally, it is applicant's objective to retain the practical range of motion between the sanding screen and the tubular handle, inherent in a conventional pole sander that does not incorporate vacuum-assisted particulate removal. Further, it is applicant's objective to provide a simple, robust design, that can be manufactured economically, and intuitively instills manufacturer and consumer confidence in the functionality and durability of the invention.

When a short side of the sanding pad is moved toward the tubular handle, the present invention displaces the bifurcated hose junction laterally in relation to the linear axis of the tubular handle. When a long side of the sanding pad is moved toward the tubular handle, the hose junction is rotated in place on the tubular handle. This range of motion of the hose junction enables the present invention to incorporate a more comprehensive, symmetrical range of motion between the sanding pad assembly and the tubular handle than the prior art.

More energy is lost to the effects of friction in turbulent flow than in laminar flow. Work is defined as energy inversely proportional to area. If energy is increased and the area over which it is applied remains constant, then work is proportionally increased. Therefore, a fluid in laminar flow has more energy available to do work. A passageway is provided for the air stream without unnecessary chambers, obstructions, or constrictions. The resulting laminar flow of the air stream through the present invention conserves the energy available to the system. As more energy is available to the air stream at the sanding screen, the effective removal of abraded material is increased. Alternatively, the speed of the sanding screen across the work surface can be increased without loss of effectiveness, thereby reducing the time spent on the sanding process.

The present invention incorporates fewer, more robust parts than the prior art. This design reduces manufacturing costs and processes, and increases durability and consumer confidence.

Other advantages will become apparent from the specifications and drawings.

DETAILED DESCRIPTION OF THE DRAWINGS

In the following description, specific material compositions are representative only and, as such, should not limit the scope of the invention.

Figure 4:
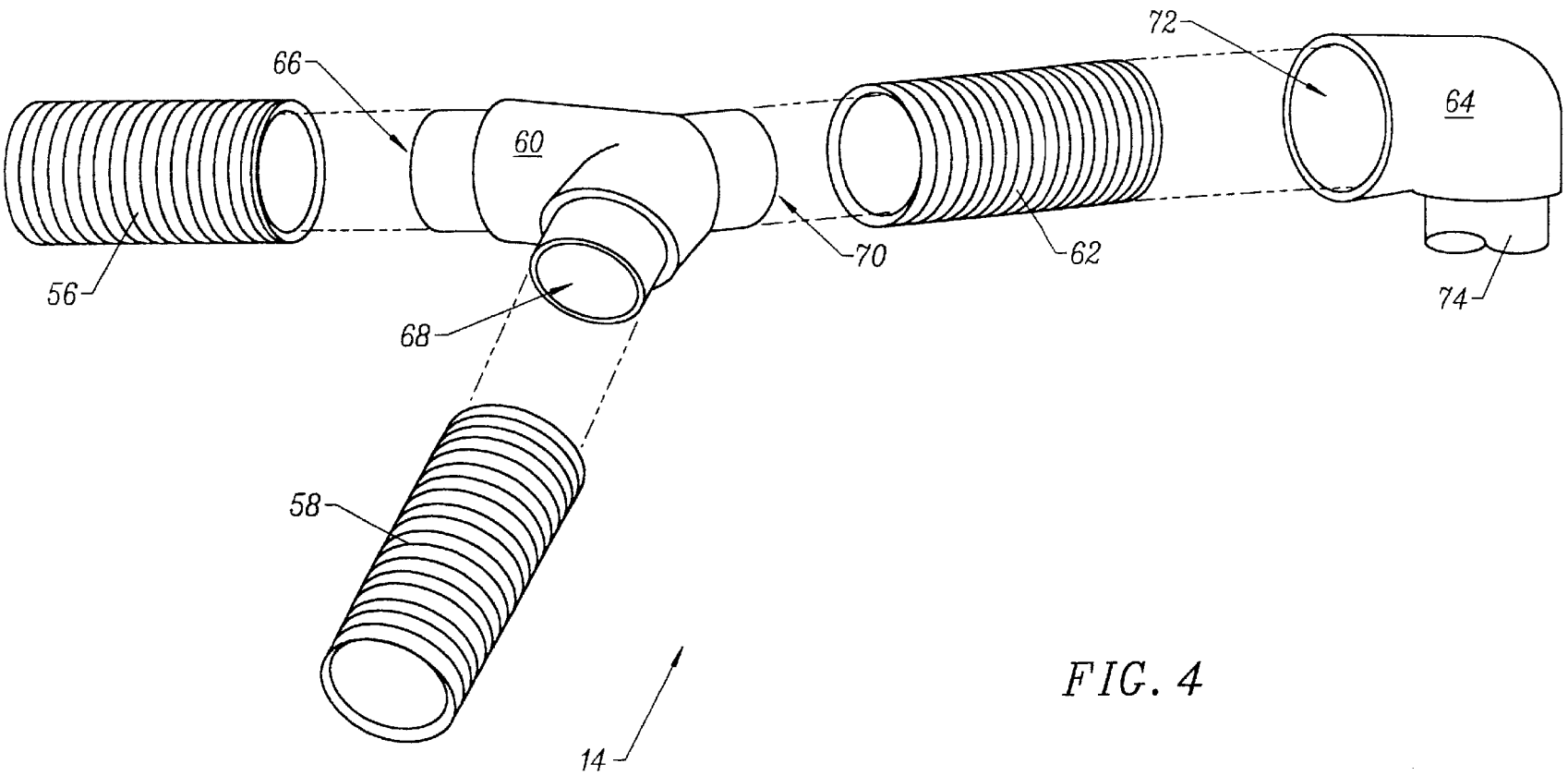
FIG. 4 is an exploded view of the bifurcated hose junction.
Figure 7:
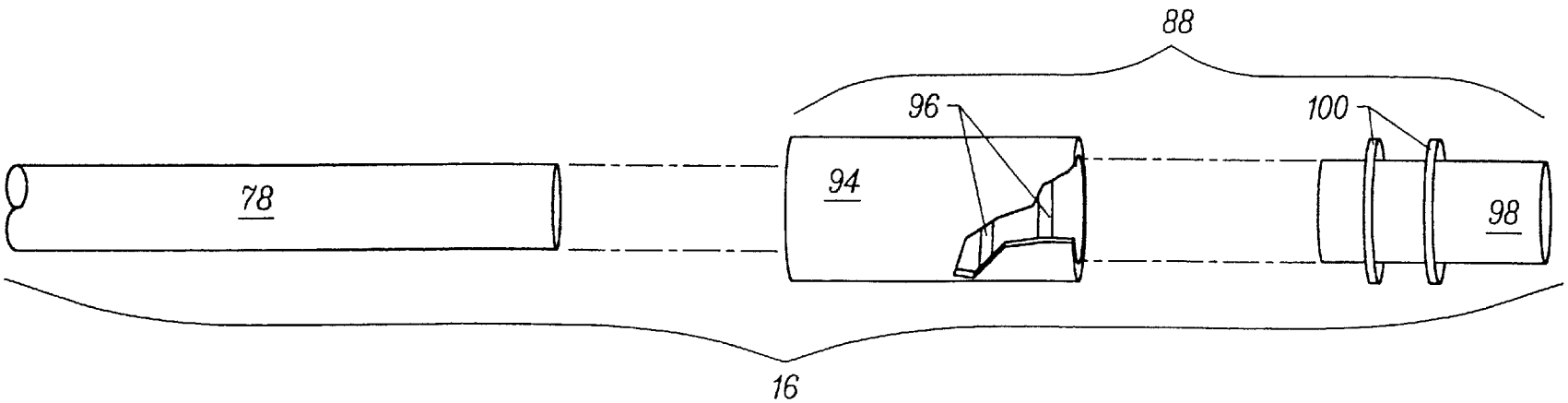
FIG. 7 is an exploded view of the tubular handle assembly, open end.
Figure 8:
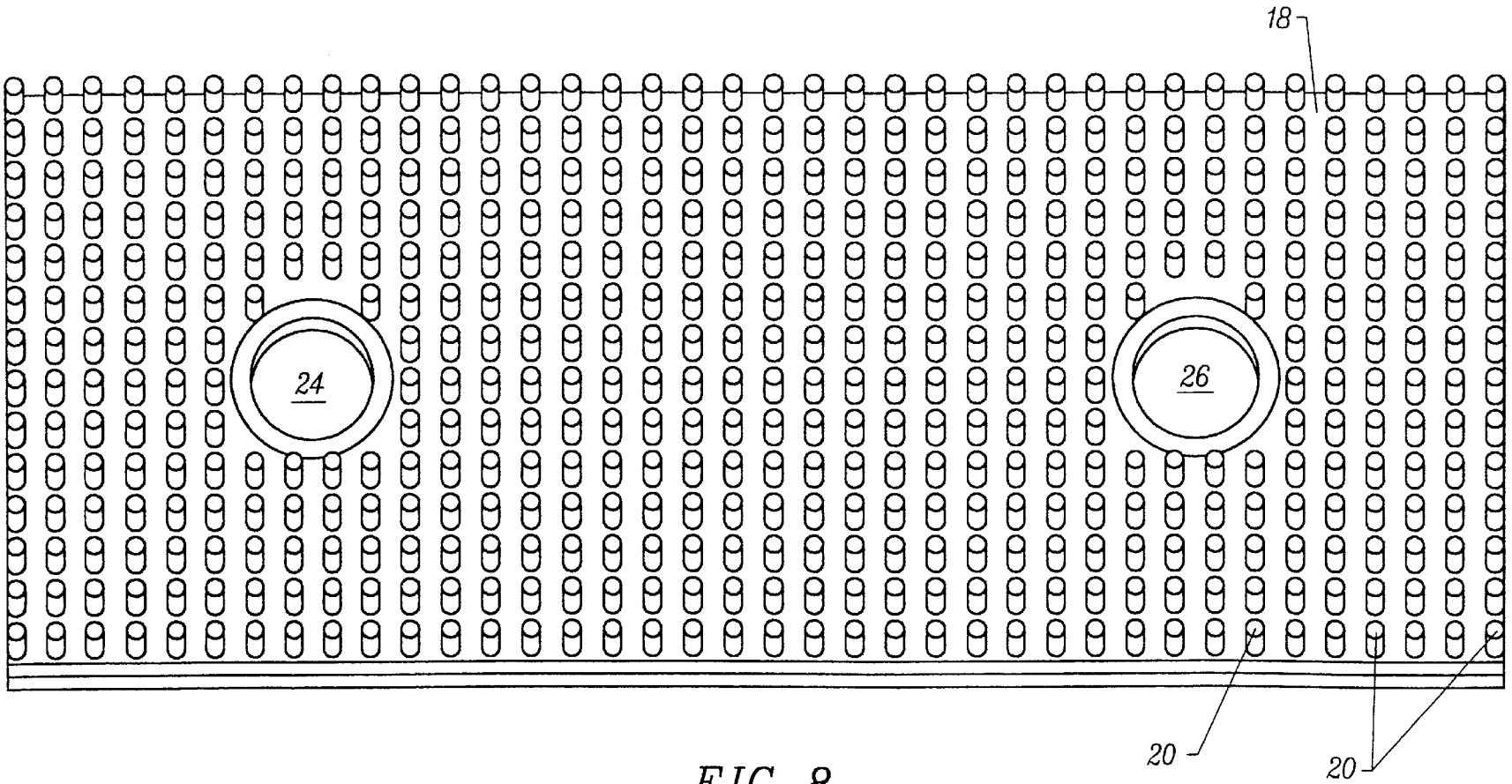
FIG. 8 is a perspective view of the sanding pad, showing the support pegs that carry the sanding screen.

The vacuum sanding pole of the invention includes a sanding pad assembly 12 (FIG. 5), a vacuum hose assembly 14 (FIG. 4), and a tubular handle assembly 16 (FIG. 7).

The pad assembly 12 (FIG. 5) includes a flexible sanding pad 18 having a plurality of elongated, cylindrical pegs 20 molded perpendicular to a rectangular planar surface of the pad 18, preferably, an abrasion-resistant, elastomeric-polyurethane composite. The pegs 20 support a conventional sanding screen a predetermined distance from the pad 18. The pad 18 is mounted directly to a rigid, preferably cast aluminum, base plate 22 by a suitable adhesive. The pad 18 has first and second vacuum portals 24, 26 that are aligned with first and second vacuum portals 24*a*, 26*a*, respectively (not shown), in the base plate 22. First and second tubular flanges 28, 30 extend from the base plate at the first and second vacuum portals 24*a*, 26*a*, respectively (not shown). Conventional sanding screen clamps 32 are mounted proximal to the short sides, and perpendicular to the linear axis of the base plate 22. The sanding screen clamps 32 comprise a "U" shaped metal channel held to the base plate 22 by wing nut 34 on machine screws 36 mounted to the base plate 22. The universal joint 38 is of conventional design and includes a threaded shaft 40 and two orthogonally disposed pivot axes 42, 44, respectively. The axes 42, 44, allow the angle between the sanding screen's planar surface and a tubular handle 46 to be continuously adjustable over a predetermined range. The universal joint 38 is attached to the base plate 22 by a roll pin 46 through the pivot axis 44 disposed orthogonally to the linear axis of the base plate 22. Each end of the roll pin 46 is friction fit into a first and second aperture 48, 50, in a first and second ridge 52, 54, respectively, cast into the base plate 22.

The vacuum hose assembly 14 (FIG. 4) includes a first and second vacuum hose 56, 58, a bifurcated and "floating" Y-shaped hose junction 60, a common vacuum hose 62 and a pipe connector 64.

Figure 5:
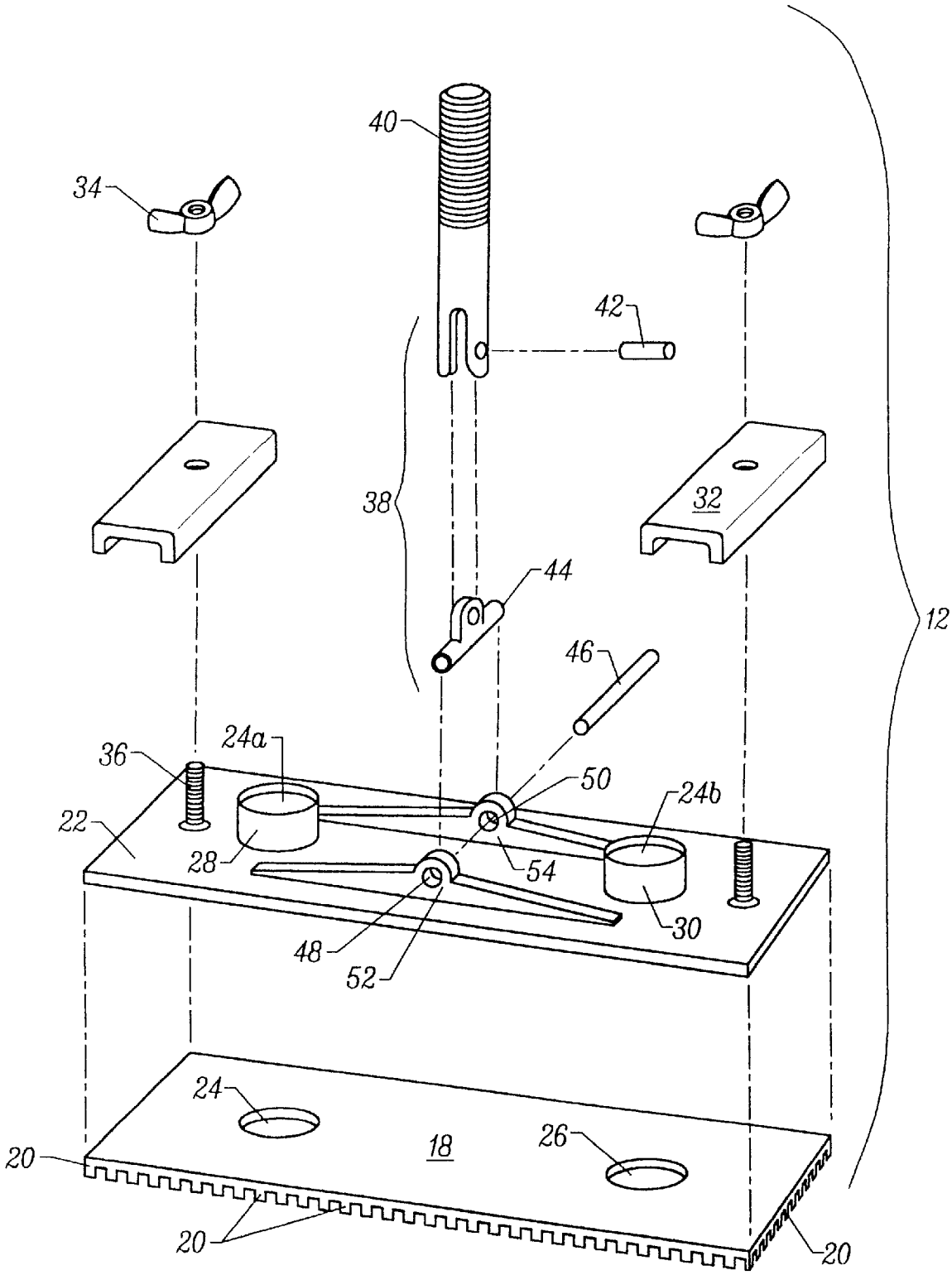
FIG. 5 is an exploded view of the sanding pad assembly.

Each of the first and second hoses 56, 58 is connected by one open end to a first and second flange 28, 30, respectively, on the base plate (FIG. 5). The opposite open end of the hose 56, 58 is attached to a first and second vacuum portal 66, 68,' respectively, of the floating, Y-shaped hose junction 60 by a tubular flange connection. The common portal 70 of the floating, Y-shaped hose junction 60 is connected to one open end of the hose 62 by tubular flange connection. The opposite open end of the hose 62 is friction fit into a first vacuum portal 72 of the pipe connector 64 and secured with a suitable adhesive. Preferably, vacuum hoses 56, 58, 62 are supple, accordion-type, elastomeric polyurethane composition reinforced with an internal helical wire. A tubular flange 74 extends from a second vacuum portal 76 opposite the hose 62.

Figure 6:
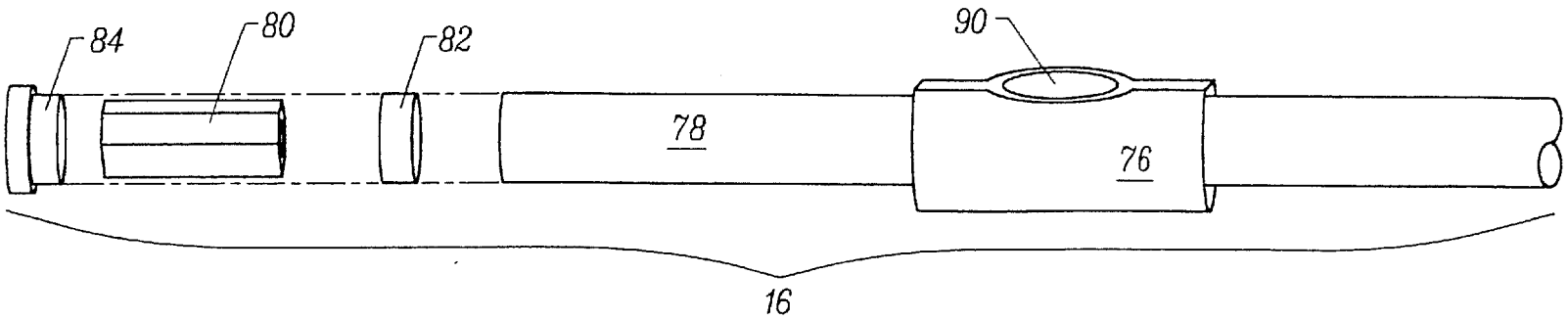
FIG. 6 is an exploded view of the tubular handle assembly, closed end.

The tubular handle assembly 16 (FIGS. 6 and 7) includes a tubular handle 78, a coupler nut 80, an inner and outer spacer 82, 84, respectively, a pipe connector 86, and a swivel hose connector 88. The tubular handle 78, preferably aluminum, includes a distal closed end that extends to pad assembly 12, a vacuum portal, and a proximal open end. The pipe connector 86 (FIG. 6) is a predetermined distance from the distal closed end of the tubular handle 78. Vacuum portal 90 is aligned with the vacuum portal in the tubular handle 78. The flange 74 is removably inserted into a vacuum portal 90 in pipe connector 86 which is connected to the tubular handle 78 by a suitable adhesive. The vacuum portal 76 of the pipe connector 64 is aligned with the portal in the tubular handle 78 and establishes a fluid communication between the hose assembly 14 and the handle 78. The universal joint 38 (FIG. 5) is removably attached to the tubular handle 78 by means of a conventional coupler nut 80 (FIG. 6). The coupler nut 80 is held centered in one end of the tubular handle 78 by an inner spacer 82 and an outer spacer 84, preferably nylon, The coupler nut 80 is attached to the tubular handle 78, preferably by a suitable epoxy. When the coupler nut 80, the inner and outer spacers 82, 84, respectively, and the threaded shaft 40 of the universal joint 38 are in place, the end of the tubular handle 78 is effectively sealed. The open end of the tubular handle 78 is connected to a conventional swivel hose connector 88 (FIG. 7) by a suitable adhesive. The swivel hose connector 88 includes a pipe coupler 94, modified with interior grooves 96, and a coaxially disposed rigid tube 98, with external ridges 100 aligned to fit into the grooves 96 in the pipe coupler 94. The grooves 96 and ridges 98 retain the tube 98 in the pipe coupler 94 while allowing the tube 98 to rotate around its linear axis. The swivel hose connector 88 allows the vacuum sanding pole to be attached to a vacuum source (not shown). The hose junction 60, pipe coupler 94 and connectors 64, 86, respectively, preferably are a polyvinylchloride composition.

The swivel hose connector 88 of the tubular handle 78 is attached to a vacuum source, such as a hose of a utility vacuum cleaner. The conventional sanding screen is positioned on the sanding pad assembly 12, and clamped in place. The operator then urges the sanding screen along the work surface, thereby abrading the imperfections in the surface. The abraded material is deposited in a suitable container. The sanding pad assembly/vacuum hose assembly 12/14, respectively, may be removed from the tubular handle assembly 16 as a unit by removing the pipe connector flange 74 of the vacuum hose assembly 14 from the pipe connector 86 on the tubular handle 78, and unscrewing the threaded shaft 40 of the universal joint 38 from the coupler nut 80 in the tubular handle 78. The tubular handle assembly 16 may then be stored in a rack while the pad/hose assembly 12/14, respectively, is stored in a tool box or other protected location.

Figure 1:
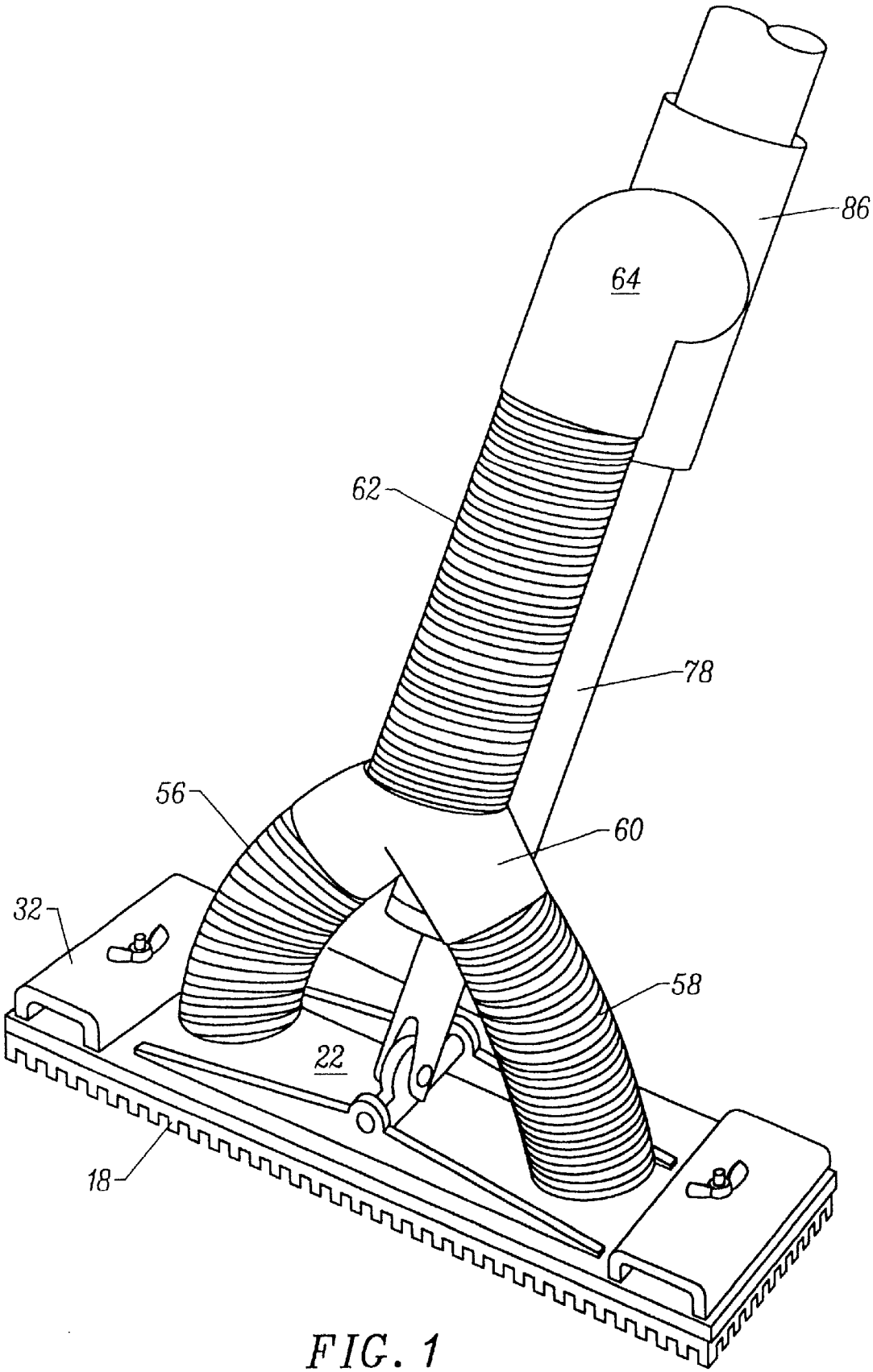
FIG. 1 is a perspective view of the sanding pole according to the invention.
Figure 2:
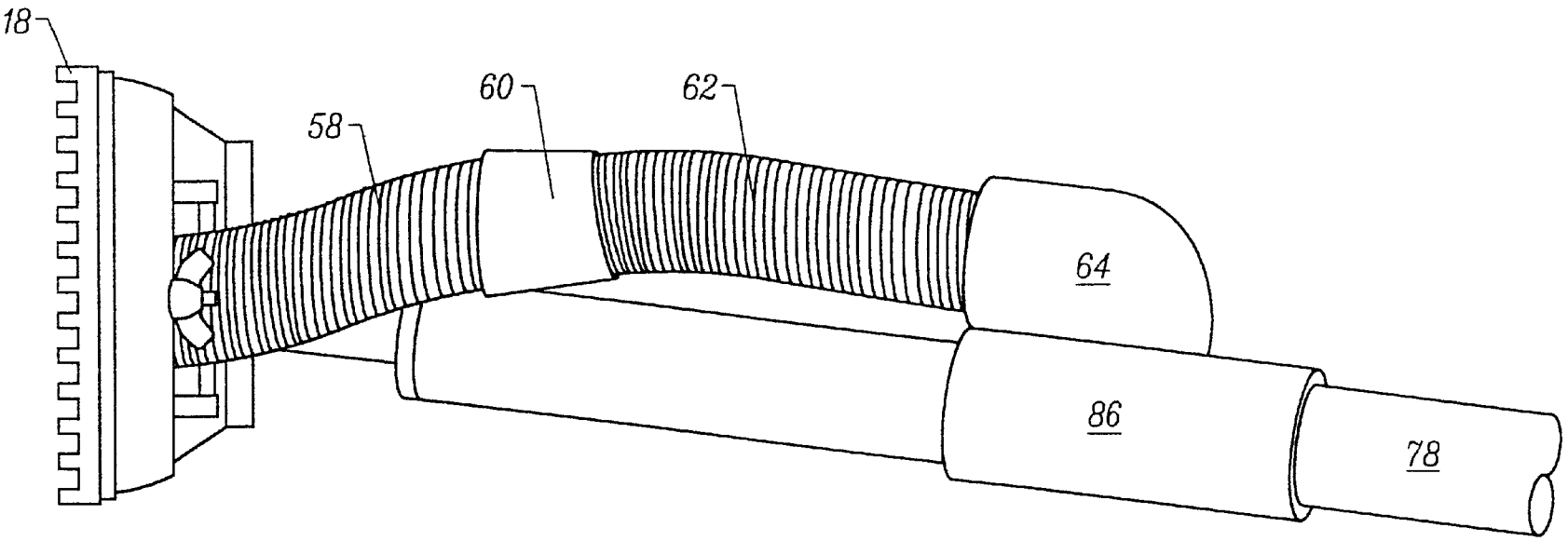
FIG. 2 is a side view of the sanding pole shown in FIG. 1.
Figure 3:
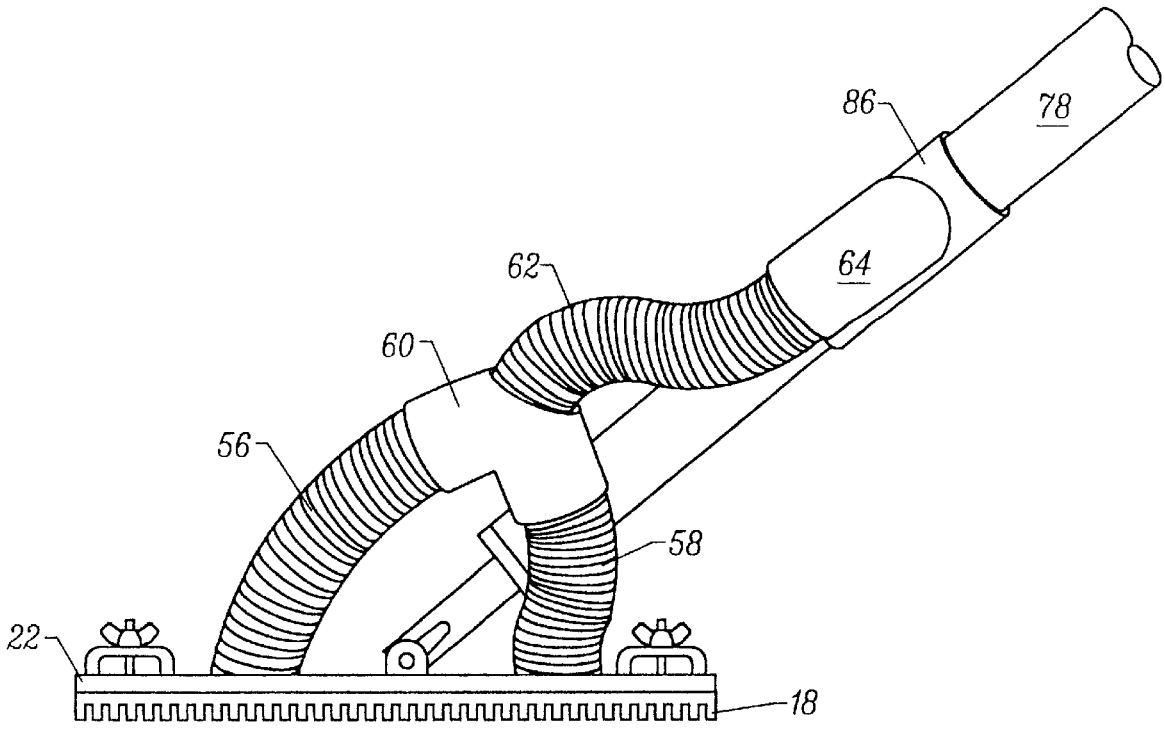
FIG. 3 shows a bifurcated hose junction used in the sanding pole shown in FIGS. 1 and 2 as displaced laterally by position of the sanding pad assembly.

When a short side of the rectangular pad 18 is moved toward the tubular handle 78, the vacuum sanding pole displaces the floating hose junction 60 laterally in relation to the linear axis of the tubular handle 78, as shown in FIG. 3. This "floating" of the hose junction 60 achieves what is also referred to herein as an "actuated hose junction." When the long side of the sanding pad 18 is moved toward the tubular handle 78, the hose junction is displaced along the linear axis of the tubular handle 78. This range of motion of the floating or actuated hose junction 60 enables the sanding pad assembly 12 to incorporate nearly as great a range of motion as if no vacuum hose was connected to it.

As the vacuum sanding pole is applied to the work surface, a plurality of interconnecting channels is created between the pegs 20 and the planar base of the pad 18 and the work surface. When a vacuum source is applied to the hose connector 88, a fluid communication is established between the sanding screen and the vacuum source. The air flow through the channels between rows of pegs produces the venturi effect, thereby drawing the particulate through the sanding screen into the air stream. The abraded material is drawn through the aligned vacuum portals 24,26,24*a*,26*a*, respectively, of the pad 18 and the base plate 22 and into a continuous, unobstructed passageway toward the vacuum source. The use of elongated support pegs 20 facilitates a more laminar flow than achieved by the prior art. In effect, the surface being sanded forms one wall of a plenum chamber, and the support pegs 20 do not significantly obstruct air flow through the passageways formed between rows of pegs.

The applicant believes that the present invention performs better than the prior art for the following reasons. First, the air stream generated in the passageways of the sanding head are more laminar than the prior art. Laminar air flow allows the air stream to flow at higher velocity than the prior art, and therefore has more kinetic energy. The increased kinetic energy is available to do the work of moving the abraded particles. As the air stream flows around the particle, the surface friction exceeds the momentum of the particle. The particle is accelerated along the path of the air stream until surface friction reaches a relative minimum value and the momentum of the particle reaches a relative maximum value. The particle then continues at constant velocity toward the vacuum source.

The foregoing description of the invention has been presented for purposes of illustration and description and is not intended to be exhaustive or to limit the invention to the precise form disclosed. The drawings were chosen and described to best explain the principles of the invention and its practical application to thereby enable others skilled in the art to best use the invention in various embodiments and with various modifications suited to the particular use contemplated. The scope of the invention is to be defined by the following claims.

What is claimed is:

1. A vacuum pole sander for sanding a work surface and vacuuming abraded particles sanded therefrom, comprising:

an elastomeric sanding pad, said sanding pad having a base carrying a plurality of upstanding support pegs, said support pegs being arranged in rows to maximize laminar flow of air along the open channels formed between said rows, each of said support pegs having a first end connected to said base and a freestanding tip, wherein said base and said plurality of upstanding support pegs are integrally formed together, a flexible and porous sanding screen carried by said freestanding tips of said support pegs, whereby abraded particles pass directly through said porous sanding screen and into the channels formed between said rows of pegs, a rigid and hollow tubular handle for supporting said sanding pad and allowing application of vacuum therethrough, means for removably connecting said sanding pad to said tubular handle whereby said sanding pad is supported by and articulates relative to said tubular handle, and hose junction means for establishing a fluid communication between said hollow, tubular handle and said sanding pad, said hose junction means being removably connected to said hollow, tubular handle, whereby said sanding pad and hose junction means can be readily disconnected from said hollow, tubular handle.

2. The apparatus of claim 1 further comprising first and second vacuum ports formed in said elastomeric sanding pad and vacuum means for applying a vacuum through said tubular handle to said elastomeric sanding pad.

3. The apparatus of claim 1 wherein said means for removably connecting said sanding pad to said tubular handle comprises a threaded connection.

4. The apparatus of claim 1 wherein said hose junction means is connected to said hollow, tubular handle by a quick-connect fitting.

* * * * *